US006516019B2

(12) United States Patent
Takizawa et al.

(10) Patent No.: US 6,516,019 B2
(45) Date of Patent: Feb. 4, 2003

(54) OXIDATION PREVENTION METHOD OF METAL IN A MELTING VESSEL AND APPARATUS

(75) Inventors: Kiyoto Takizawa, Nagano-ken (JP); Toshiyasu Koda, Nagano-ken (JP); Yuji Hayashi, Nagano-ken (JP); Mamoru Miyagawa, Nagano-ken (JP)

(73) Assignee: Nissei Plastic Industrial Co., Ltd., Nagano-ken (JP)

( * ) Notice: Subject to any disclaimer, the term of this patent is extended or adjusted under 35 U.S.C. 154(b) by 0 days.

(21) Appl. No.: 09/924,851

(22) Filed: Aug. 8, 2001

(65) Prior Publication Data

US 2002/0021736 A1 Feb. 21, 2002

(30) Foreign Application Priority Data

Aug. 9, 2000 (JP) ..... 2000-241423

(51) Int. Cl.[7] ..... F27D 23/04

(52) U.S. Cl. ..... 373/85; 373/116; 373/146; 164/113

(58) Field of Search ..... 373/8, 9, 4.2, 60, 373/79, 80, 84, 85, 109, 116, 139, 144, 145; 164/4.1, 113, 154.6, 312, 900; 425/557–559, 561, 568, 573, 585, 587; 266/79, 156, 88, 94, 99; 75/10.36, 382, 386, 387, 709

(56) References Cited

U.S. PATENT DOCUMENTS 4,543,124 A * 9/1985 Vallomy ..... 373/109
5,380,187 A * 1/1995 Fujikawa ..... 425/561
5,479,436 A * 12/1995 Hashida et al. ..... 373/144
5,499,915 A * 3/1996 Fujita ..... 425/557
5,704,411 A * 1/1998 Suzuki et al. ..... 164/113
5,999,556 A * 12/1999 Haissig ..... 373/9
6,004,504 A * 12/1999 Vallomy ..... 266/79
6,405,784 B2 * 6/2002 Takizawa et al. ..... 164/113

* cited by examiner

*Primary Examiner*—Tu Ba Hoang
(74) *Attorney, Agent, or Firm*—Weingarten, Schurgin, Gagnebin & Lebovici LLP

(57) ABSTRACT

It is an object of the present invention to prevent oxidation during the metal melting, by suspending both heating and supply of metal material under the monitoring by measuring the oxygen concentration in the inactive gas atmosphere. A oxidation prevent method of melting metal material by a melting vessel 1 comprising inside a rotatable agitation member 8, having a weighing chamber 4 communicating with a nozzle member 2, and an injection member 9 advanceably and retractably inserting an extremity injection plunger 12 passing through the agitation member 8 in the weighing chamber 4, and the melting vessel being installed on a slant with the nozzle member 2 downside. The space area over the melted metal surface 15*a* of the melting vessel 1 is made into inactive gas atmosphere. The oxygen concentration in this space area is measured and monitored. It is judged as error when the measured oxygen concentration exceeds a predetermined reference value, and heating and material supply are suspended to prevent the melt metal from oxidizing.

2 Claims, 1 Drawing Sheet

OXIDATION PREVENTION METHOD OF METAL IN A MELTING VESSEL AND APPARATUS

BACKGROUND OF THE INVENTION

1. Field of the Invention

The present invention concerns a method for preventing metal material from oxidation in case of melting low fusion point nonferrous metal such as zinc, magnesium or their alloy in a melting vessel for injection molding.

2. Detailed Description of the Prior Art

As oxygen in the atmosphere deposits, sticks or adheres as oxidation surface layer to the surface of granular metal and oxygen in the atmosphere tends to be born with metal material during the supply, the metal material is susceptible to be oxidized, even melted in a melting vessel, when heated and melted in the melting vessel as it is.

When melt metal is oxidized, metallic splash caused through agitation adheres and lies on the vessel inner wall and agitation member or others, as impure oxidized sludge, causing malfunction of agitation member or plunger, or mixing into the melt metal as impurities with oxides of the melt metal surface, provoking deterioration of injection molded metal products.

Therefore, the oxidation is controlled by reducing the oxygen concentration in the melting vessel by sucking atmospheric oxygen with a vacuum pump during the material supply, or supplying in the melting vessel with inactive gas such as argon all the time to heat and melt metal material in the inactive gas atmosphere. However, as for oxygen due to surface oxidation of the metal material caused in the natural state, the metal material is heated and melted as it is, because it is extremely little, and there is no effective exclusion means.

In this situation, if the melting is performed during the material supply, the oxygen concentration in the melting vessel increases to accelerate the oxidation of the melt metal surface, even in the inactive gas atmosphere. Existence of oxygen due to the surface oxidation is believed to be one cause of the increase of oxygen concentration and even if its quantity is small, it will end by exceeding the prescribed value of oxygen concentration, so it is earnestly desired to lower below the prescribed value by any means.

SUMMARY OF THE INVENTION

The present invention has an object of providing a novel oxidation prevention method of melt metal in the melting vessel and an apparatus allowing to solve the oxidation problem during the melting of metal, by suspending both heating and supply of metal material under the monitoring by measuring the oxygen concentration in the inactive gas atmosphere.

The oxidation prevention method of the present invention for solving the problem is a method for melted metal material by a melting vessel, comprising inside a rotatable agitation member having a weighing chamber communicating with a nozzle member and an injection member advanceably and retractably inserting an extremity injection plunger passing through the agitation member in the weighing chamber, and the melting vessel being installed on a slant with the nozzle member downside, comprising the steps of; making a space area over the melted metal surface of the melting vessel into inactive gas atmosphere, measuring and monitoring the oxygen concentration in the space area, judging as error when the measured oxygen concentration exceeds a predetermined reference value, and stopping heating and material supply.

The oxidation prevention apparatus of the invention is the one having a weighing chamber communicating with a nozzle member, comprising inside a rotatable agitation member, and an injection member advanceably and retractably inserting an extremity injection plunger passing through the agitation member in the weighing chamber, wherein a supply tube at a supply inlet of a melting vessel installed on a slant with the nozzle member downside is erected, a supply apparatus of granular metal material is connected to the supply tube and, at the same time, a gas piping for supplying to a space area over the melted metal surface of the melting vessel with inactive gas atmosphere is disposed in the supply tube or at a top portion, and an oxygen detector having transmission function is mounted on the supply apparatus over the supply tube by facing an oxygen sensor in the supply tube.

DETAILED DESCRIPTION OF THE PREFERRED EMBODIMENT

Figure 1:
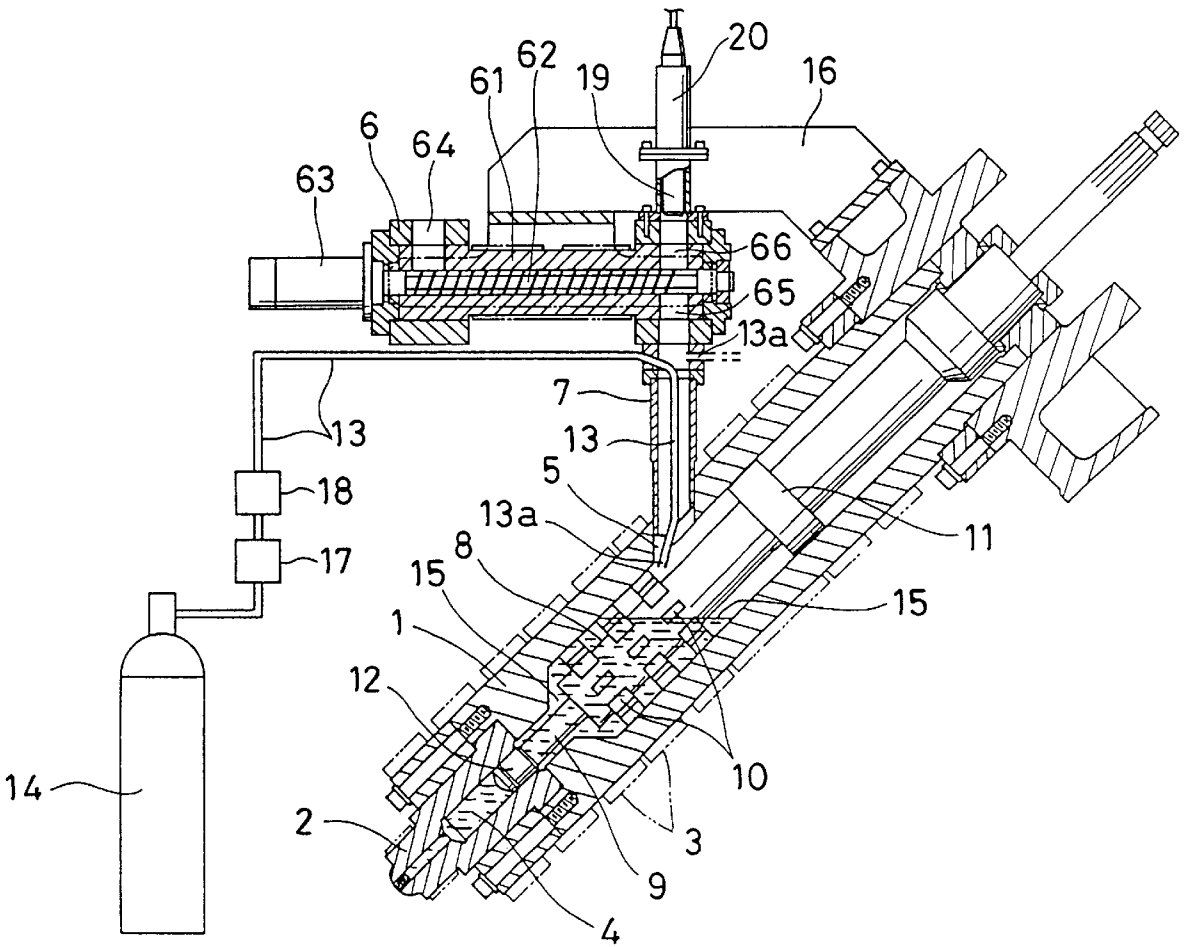
FIG. 1 is a schematic view of an apparatus allowing to perform the oxidation prevention method of melt metal in a melting vessel according to the present invention.

In the drawing, 1 is a melting vessel of metal material, composed of a cylinder comprising a band heater 3 around the outer periphery. This melting vessel 1 is installed on a slant with an angle of 45° in respect to a squeeze apparatus (not shown) with a nozzle member 2 disposed at the extremity thereof. A required length of weighing chamber 4 is defined with a diameter smaller than the vessel inner diameter, in the extremity of the melting vessel 1 communicating with the nozzle member 2.

A supply inlet 5 is opened upward at the middle of the melting vessel 1, and a supply apparatus 6 of metal material is held by a member 16 attached to the melting vessel 1 and connected to a supply tube 7 erected at this supply inlet 5.

The rear end of the melting vessel 1 is open, and an agitation member 8 and an injection member 9 of melt metal 15 composing the agitation and injection means are installed inside from this rear end.

The agitation member 8 is composed of a rotation shaft provided with several lines of rotational agitation fin 10 formed discontinuously around the outer periphery of the extremity portion. This agitation fin 10 has an outer diameter substantially equal to the inner diameter of the melting vessel 1, and a partition flange 11 serving also as guide is formed integrally in contact with the inner peripheral surface of the melting vessel 1, around the shaft section periphery behind the agitation fin 10.

The injection member 9 mentioned above, has an injection plunger 12 engaged with the aforementioned weighing chamber 4 from the front of the agitation member 8, advances with the injection plunger 12, and fills a not shown mold with a predetermined quantity of melt metal 15 stored in the weighing chamber 4, by injecting from a nozzle member 2.

13 is a gas piping of inactive gas such as argon, connecting with a pressure vessel 14. This gas piping 13 is installed in the melting vessel 1 by passing through the inside from the upper portion of the supply tube 7 and positioning an open end 13a near the agitation fin 10 under the supply inlet 5, or by connecting the open end 13*a* to the upper portion of the supply tube 7 as shown by the chain line.

A reducing valve 17 and a flow rate valve 18 are arranged near the pressure vessel 14 of the gas piping 13, thereby, allowing to control the discharge pressure and the flow rate of inactive gas charged in the pressure vessel 14.

The supply apparatus 6 comprises a screw conveyer 62 in a horizontal cylinder 61, has a structure for transporting granular metal material into said supply tube 7 connected to a delivery port 65 under the cylinder front, from the input port 64 above the cylinder rear section, by turning this screw conveyer 62 by an electric motor 63 at the cylinder read end and, a communication hole 66 is perforated on the front of the cylinder 61 above this supply tube 7, to mount an oxygen detector 20 having transmission function, facing an oxygen sensor 19 to the inside of the supply tube 7 from the communication hole 66.

This oxygen detector 20 is, though not illustrated, connected electrically to both of a heater power source of the aforementioned band heater 3 and a motor power source of the supply apparatus 6, and these power sources are set to be turned OFF by inputting an electric signal output from the oxygen detector 20.

In the composition, inactive gas is injected over the melt metal surface 15*a* of the melting vessel 1 from the pressure vessel 14 through the gas piping 13, or in the supply tube 17, making the space area in the melting vessel 1 inactive atmosphere. This prevents melt metal material from oxidizing, even when oxygen is taken in the melting vessel 1. Moreover, a part of inactive gas supplied into the melting vessel 1 is discharged from a gap over the melting vessel 1 or the input port 64, because the melting vessel 1 is disposed on a slant. This prevents the atmosphere from entering the melting vessel 1 from the upper part, and also the atmosphere is prevented from entering through the input port 64, as the metal material is transported by the inactive gas also in the supply apparatus 6, limiting the oxygen penetration causing oxidation to a small quantity of oxygen on the oxidized surface of metal material.

The concentration of oxygen inside the melting vessel 1 and supply tube 7 is always measured by the oxygen sensor 19 of the oxygen detector 20. When the measured oxygen concentration is equal or inferior to a predetermined reference value (par example 10 ppm), heat melting operation by the heater and the supply of material by the supply apparatuses are continued. Then the melt metal is weighed, injected and charged into the mold by the advance and retrogression movement of the aforementioned injection plunger 12.

However, if the oxygen concentration measured by the oxygen sensor 19 exceeds the prescribed 10 ppm, the oxygen detector 20 outputs an error signal. This output signal turns OFF the heater power source of the band heater 3 to stop heating and, at the same time, the motor power source of the supply apparatus 6 is also turned OFF, stopping the material supply, and continuing only argon supply.

This suspension of material supply prevents oxygen from adhering to the surface of granular material and prevents from entering the melting vessel 1, allowing to control the oxygen concentration equal or inferior to the prescription. The heating suspension controls also the temperature of the melt metal.

When the oxygen concentration becomes equal or inferior to the prescribed reference value by this heat suspension and supply suspension, both the heater power source and the motor power source are turned ON to resume the heating and the material supply, starting to melt new metal material.

Consequently, oxidation of metal material melt in the melting vessel 1, especially oxidation of the melt metal surface or sludge adhered to the wall surface or members in the space area as splash is controlled and, even when sludge drops on the melt metal surface and gets mixed with the melt metal, the mixture as oxidized impurities is prevented, allowing to improve the quality and the molding accuracy, even for the metal product mold by injecting melt metal into a mold.

Moreover, in the melting and injection molding process, the malfunction of agitation members or injection members by oxidized sludge that is accumulated hardly is prevented and inconveniences by oxides are resolved even for a prolonged molding, allowing to maintain a stable molding for a long time.

What is claimed is:

1. An oxidation prevention method for melted metal material in a melting vessel, said vessel provided with a weighing chamber communicating with a nozzle member in an extremity thereof, a rotatable agitation member and an injection member having an extremity injection plunger advanceably and retractably inserted in said weighing chamber by passing through the agitation member, said nozzle member being installed on a slant within a downside of said melting vessel, when melting metal material in the melting vessel; said method comprising the steps of, providing in a space area over the melted metal surface of said melting vessel an inactive gas atmosphere, measuring the oxygen concentration in the space area, providing an error indication when the measured oxygen concentration exceeds a predetermined reference value, and stopping heating and material supply in response to said error indication.

2. An oxidation prevention apparatus for melted metal in a melting vessel comprising:

a melting vessel provided with:

a weighing chamber communicating with a nozzle member in an extremity thereof;

a rotatable agitation member; and an injection member having an extremity injection plunger advanceably and retractably inserted in said weighing chamber by passing through the agitation member, wherein:

the nozzle member is installed on a slant in a down side of the melting vessel;

a supply tube is erected at a supply inlet of the melting vessel;

a supply apparatus of granular metal material is connected to the supply tube; and a gas piping for supplying inactive gas to a space area over a melted metal surface of said melting vessel is disposed in or on the supply tube; and an oxygen detector having a detector signal transmission function is mounted on said supply apparatus over the supply tube and facing an oxygen sensor in the supply tube.

* * * * *